US005779106A

United States Patent [19]

Albini et al.

[11] Patent Number: 5,779,106

[45] Date of Patent: Jul. 14, 1998

[54] ATOMIZED LIQUID DISPENSER

[75] Inventors: Giovanni Albini; Tommaso Ruscitti, both of Milan; Franco Carlappi, Pianello Valtidone, all of Italy

[73] Assignee: TER S.R.L., Milan, Italy

[21] Appl. No.: 676,812

[22] Filed: Jul. 8, 1996

[30] Foreign Application Priority Data

Jul. 17, 1995 [IT] Italy ..... MI95A1544

[51] Int. Cl.[6] ..... B67D 5/42

[52] U.S. Cl. ..... 222/321.3; 222/321.8; 222/380; 222/496; 239/570

[58] Field of Search ..... 239/570, 583, 239/333, 473; 222/321.3, 321.7, 321.8, 321.9, 380, 496

[56] References Cited

U.S. PATENT DOCUMENTS

| | | | |
|---|---|---|---|
| 3,584,789 | 6/1971 | Traynor . | |
| 4,182,496 | 1/1980 | Burke . | |
| 5,085,353 | 2/1992 | Inui et al. . | |
| 5,429,275 | 7/1995 | Katz | 222/321.8 X |
| 5,558,258 | 9/1996 | Albini et al. | 222/496 |
| 5,577,640 | 11/1996 | Albini et al. | 222/380 X |
| 5,624,055 | 4/1997 | Clanet et al. | 222/380 X |

FOREIGN PATENT DOCUMENTS

| | | |
|---|---|---|
| 0 670 275 | 9/1995 | European Pat. Off. . |
| WO 93/01100 | 1/1993 | WIPO . |

*Primary Examiner*—Kenneth Bomberg

*Attorney, Agent, or Firm*—Oblon, Spivak, McClelland, Maier & Neustadt, P.C.

[57] ABSTRACT

An atomized liquid dispenser, comprising a pump and a dispensing head mounted on the stem of the pump, the head defining a chamber communicating with the stem and housing a movable piston urged by a spring to close a discharge nozzle provided at one end of the chamber. From the head there extends a skirt in which cuts are provided which define a flexible tang engaging one end of said piston projecting from said chamber. From the inner surface of the tang there projects a cam which, when the pump is operated, interferes with the pump or with an element rigid with it, to cause the tang to flex outwards and axially entrain the piston, so withdrawing it from the discharge nozzle.

4 Claims, 1 Drawing Sheet

ATOMIZED LIQUID DISPENSER

BACKGROUND OF THE INVENTION

1. Field of the Invention

This invention relates to a manually operated dispenser for dispensing atomized liquids under pressure.

2. Discussion of the Background

To dispense pressurized liquids in finely atomized form it is known to use manually operated pumps with a hollow liquid exit stem on which a dispensing head is mounted incorporating a chamber at which the pressurized liquid arrives from the pump stem. The pressurized liquid emerges to the outside in atomized form after passing through a discharge nozzle.

To achieve good and constant atomization without liquid dripping from the outside of the discharge nozzle the liquid pressure at this nozzle, when dispensing commences, must be sufficiently high from the beginning. Moreover, if the liquids to be dispensed tend to dry, so obstructing liquid passage through the discharge nozzle (which very easily happens, for example, if the liquid is hair lacquer, dressing liquid or the like), the discharge nozzle must be closed on termination of each dispensing operation in order to isolate from the air the liquid residues present in the pump upstream of the nozzle.

To overcome these problems, U.S. Pat. No. 4,182,496 and Italian patent application MI94A001061 (and the corresponding European patent application 95103727.4 and U.S. patent application Ser. No. 08/401,902) describe dispensing heads having a compression chamber housing a slidable piston with an appendix extending towards a discharge hole provided in an insert delimiting the compression chamber. Acting on the piston there is a spring which when under rest conditions urges that end of the piston in proximity to said appendix against a seat provided in said insert to hermetically seal the discharge hole, hence isolating any liquid present in said chamber from contact with the air. When the pump is operated, the pressurized liquid reaching said chamber through the pump stem causes the piston to move against the action of the spring, with consequent opening of the discharge nozzle.

The movement of the piston which intercepts the passage of liquid from the compression chamber of the dispensing head to the discharge nozzle hence takes place only by the effect of the thrust applied to the movable piston by the pressurized liquid present in the compression chamber.

It has been found that if the liquid to be dispensed is of the type forming incrustations by the evaporation of a constituent solvent (as in the case of hair lacquer or dressing liquid particularly rich in adhesive substances), incrustation can form (in correspondence with the discharge nozzle or in the seat against which the piston seals when in its rest state) tending to jam the piston, making it difficult or even impossible to be moved by the action of only the pressurized liquid acting on said piston.

Moreover, the dispensing heads of the type illustrated in said patents (in particular see the patent application EP-A-0688608) have the drawback of very laborious priming at the commencement of their use. In this respect, the first time liquid is dispensed, the entire internal cavities of the pump and dispensing head mounted on it are filled with air, which has to be completely evacuated to be replaced by the liquid to be dispensed. However air is a strongly compressible fluid, so that initially the pump has to be operated many times before the air present in the compression chamber of the dispensing head can be expelled to the outside. Alternatively special expedients have to be provided for venting the air on priming, these being costly or requiring specific priming operations to be carried out.

SUMMARY OF THE INVENTION

The main object of the present invention is therefore to provide an atomized liquid dispenser with a dispensing head comprising a piston movable within a compression chamber of the type illustrated in the aforesaid patents, in which a member is provided which hooks onto said piston and shifts it mechanically from its rest position, so both overcoming the resistance presented by any incrustation and allowing easy and rapid priming of the dispenser.

A further object is to provide a dispenser of the stated type having excellent operational characteristics for any type of liquid dispensed, and which is very simple and comfortable to use.

These objects are attained by a dispenser applicable to a pump for feeding a liquid under pressure to its hollow stem, comprising a cylindrical wall bounding a seat for housing the free end of said hollow stem and having a chamber communicating with the cavity in the stem and bounded at one end by a nozzle for discharging the atomized liquid into the atmosphere, a piston being housed in and translationally movable within said chamber and having a seal lip which bounds said chamber at its other end, and a spring acting on said piston in the sense of urging an appendix projecting from the piston towards said nozzle, characterised by comprising a skirt which extends from the same side as said cylindrical wall, in said skirt there being provided cuts defining in the skirt an elongate flexible tang comprising a housing into which there extends and with which there engages the shaped end of said piston emerging from said chamber at the opposite end to that at which said discharge nozzle is provided, members interfering with said tang being provided to cause it to flex outwards with consequent axial entrainment of said piston away from said nozzle when the dispenser is operated to dispense atomized liquid.

Preferably, from the flexible tang there projects a cam with which said members interfere when the dispenser is operated to dispense atomized liquid.

Again preferably, from said head there projects an outer wall extending about said skirt to protect it and allow easy gripping and operation of the dispenser.

BRIEF DESCRIPTION OF THE DRAWINGS

The structure and characteristics of the pump according to the invention will be more apparent from the description of a preferred embodiment thereof given hereinafter by way of non-limiting example with reference to the accompanying drawings, in which.

DISCUSSION OF THE PREFERRED EMBODIMENTS

Figure 1:
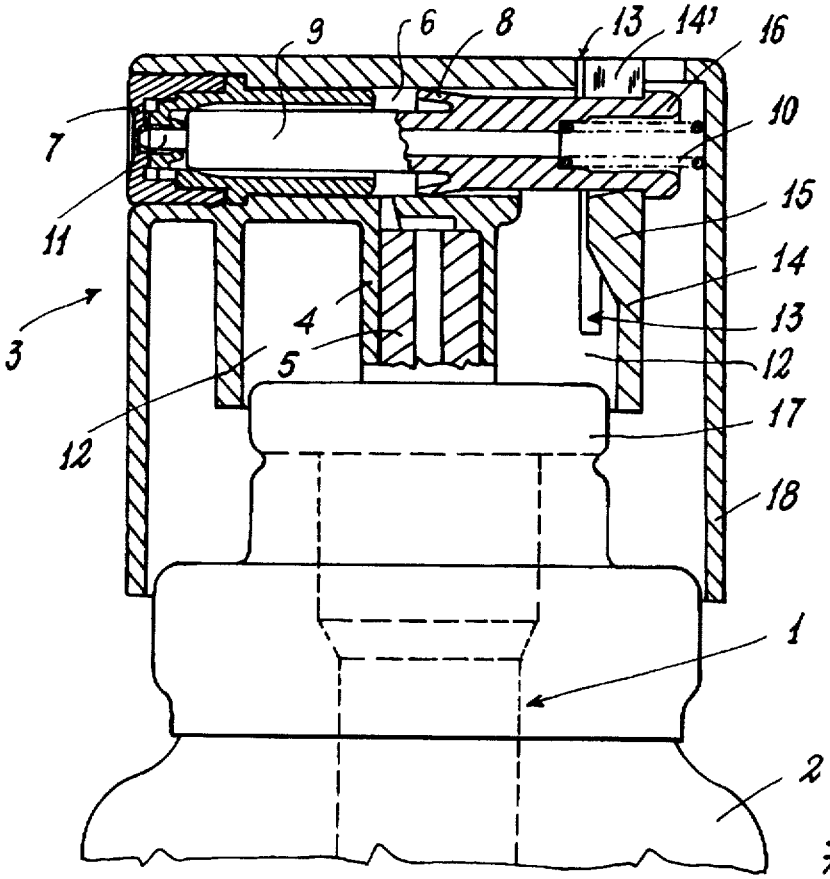
FIG. 1 is a partial longitudinal section through the dispenser in its rest position.

The dispenser shown on the drawings comprises a pump 1 (clinched onto the mouth of a container 2 containing a liquid to be dispensed) and a dispensing head 3 having a seat bounded by a cylindrical wall 4 into which the hollow stem 5 of the pump is forcibly inserted.

In the head 3 there is provided an elongate chamber 6 communicating with the cavity of the rod 5 and bounded to the left (with respect to the figures) by a nozzle 7 for discharging the atomized liquid, and to the right by the seal lip 8 of an elongate piston 9 housed and slidable within said chamber and urged by a spring 10 (acting on a rigid part of the head) towards the nozzle 7 so that, when in the rest position of FIG. 1, an appendix 11 projecting from the piston 9 is urged against the nozzle 7 to seal either directly against it or against a suitable seat provided on a bush surrounding the nozzle.

The structure of the aforesaid dispensing head is totally analogous to those illustrated in the prior patents cited in the introduction to this description.

The head 3 comprises a skirt 12 in which cuts 13 are provided to define a flexible elongate tang 14 which is connected to the skirt 12 only at its lower end (with respect to the figures). From the inner side of the tang 14 there projects a cam 15, the upper end 14' of the tang being fork-shaped.

Figure 2:
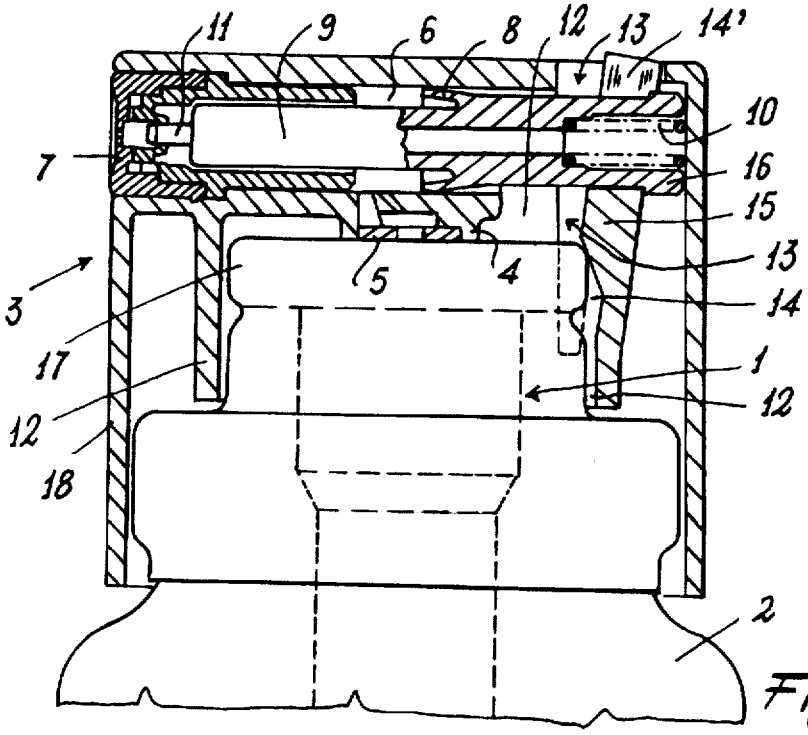
FIG. 2 a section through the same dispenser when pressed fully down.

The right end (with respect to the figures) of the piston 9 projects from the chamber 6 and comprises a projecting rib 16 which is hooked by the fork 14' of the tang 14 when said tang is made to flex towards the right (FIG. 2) when, following the operation of the dispenser (ie on lowering the stem 5 and with it the entire head 3 relative to the pump 1, ie relative to the container 2), the cam 15 comes into contact with the projecting portion 17 of the pump (this portion can also consist of a ring cap for fixing the pump onto the container, or an appropriate additional element mounted on the pump, or consist of a profiled edge projecting from the end of the pump external to the container), to slide on this projecting portion and cause the tang 14 to flex outwards so that it hooks onto the piston 9 to shift it mechanically in the sense of withdrawing it from the nozzle 7.

A fundamental characteristic of the dispenser is that, in this manner, if the piston 9 should be "stuck" in the closure position (FIG. 1), it is easily moved away from that position by the mechanical action exerted by the flexible tang 14, 14' on operating the dispenser. Finally from FIG. 1 it can be seen that an outer wall 18 forms part of the head 3 and extends totally about the skirt 12 to protect it and form a comfortable handgrip allowing easy gripping for operating the dispenser.

Another particularly important functional characteristic of the described dispenser is noted during its initial operation, when the cavity of the stem 5 and the compression chamber 6 are filled with air and contain no liquid. Under these conditions, on operating the dispenser so that it assumes the position shown in FIG. 2, the air present in the pump interior, in the stem and in the chamber 6 is easily expelled to the outside through the nozzle 7 because the piston 9 is mechanically withdrawn from the exit hole of the nozzle by the action of the tang 14. When the head 3 commences to withdraw from the pump 1, the appendix 11 of the piston 9 immediately closes the nozzle 7, to create a vacuum in the chamber 6 and within the stem cavity, causing liquid to be drawn into the pump 1 from the container 2. In this manner, after only a very few pumping actions starting with the pump empty (generally only two or three pumping actions), the pump is primed and the chamber is filled with liquid. After priming, as the liquid is an incompressible fluid, as soon as the dispenser is operated, hence lowering the pump stem 5, the liquid present in the chamber 6 and originating from the pump under pressure causes the piston 9 to retract against the action of the spring, before the cam 15 causes flexure of the tang 14. Hence, when under normal operating conditions the piston 9 is shifted into the opening position by the effect only of the pressure of the liquid present in the compression chamber 6.

If desired (according to the extent of lowering of the dispensing head 3) the flexible tang can act on the piston only at the moment of priming and when the piston is stuck in the closure position.

The mechanical operation of the piston 9 can hence occur during the descent of the head 3 (with respect to the figures) relative to the container 2, ie during the lowering of the stem 5 on the body of the pump of which it forms part.

The drawings show schematically an embodiment in which the pump is rigid with the container, the stem (and with it the dispensing head) being movable relative to said pump and container. However pumps are also known in which their hollow stem remains fixed relative to the container on which the pump is mounted, whereas a cup forming part of each pump and bounding the pump suction and delivery chamber is movable relative to the stem and hence also relative to the dispensing head mounted on it and to the container, the cup being shiftable by a lever operable with a finger to dispense the liquid.

It is apparent that also in this case the cup can have a projecting edge (or be provided with another equivalent element) shiftable towards the head 3 by an operating lever or the like forming part of the head, to interfere with the cam 15 during the raising of the cup, ie during the operation of the pump of which it forms part.

We claim:

1. A dispenser for dispensing liquids in atomized form, said liquids being received by said dispenser from a pump which feeds the liquid under pressure to a hollow stem in the pump, said hollow stem having a cavity, said dispenser comprising:

a cylindrical wall defining a seat for receiving a free end of said hollow stem;

a chamber communicating with said cavity, said chamber having a nozzle at one end for discharging said liquid in atomized form into the atmosphere;

a piston which is housed in and translationally movable within said chamber, said piston having a seal lip which seals said chamber at an end opposite said nozzle, said piston having an appendix projecting toward said nozzle;

a spring acting on said piston to push said appendix toward said nozzle;

a skirt extending in the same direction as said cylindrical wall, said skirt having cuts formed therein to form an elongated flexible tang;

said piston extending into and engaging said elongated flexible tang at the end of said piston opposite said nozzle; and deflection means for flexing said tang outwardly so as to move said piston away from said nozzle when the dispenser is operated.

2. A dispenser according to claim 1, wherein said elongated flexible tang has formed thereon a cam surface which interacts with said deflection means when the dispenser is operated.

3. A dispenser according to claim 2, further comprising an outer wall extending around said skirt.

4. A dispenser according to claim 1, further comprising an outer wall extending around said skirt.

* * * * *